United States Patent [19]

Hurd et al.

[11] 4,194,772

[45] Mar. 25, 1980

[54] PLASTIC LOCKING RING AND METHOD OF MAKING

[76] Inventors: Donald J. Hurd, 658 Ridgefield Rd., Wilton, Conn. 06897; Gerard J. Morgan, III, Anchorage 350 Grovers Ave., Suite 3A, Bridgeport, Conn. 06605

[21] Appl. No.: 851,672

[22] Filed: Nov. 15, 1977

[51] Int. Cl.[2] ..... E05C 19/00

[52] U.S. Cl. ..... 292/256.65; 292/19; 24/204

[58] Field of Search ..... 24/204; 220/46, 55, 220/67; 292/256.69, 256.6, 19

[56] References Cited

U.S. PATENT DOCUMENTS

| | | | |
|---|---|---|---|
| 3,028,993 | 4/1962 | Muhlhoff | 292/256.69 X |
| 3,198,689 | 8/1965 | Lansing | 24/259 FS |
| 3,261,632 | 7/1966 | Schaefer | 292/256.69 |
| 3,717,908 | 2/1973 | Perina | 24/204 |
| 3,841,648 | 10/1974 | Meyer | 24/204 X |

*Primary Examiner*—Richard E. Moore

*Attorney, Agent, or Firm*—Parmelee, Johnson, Bollinger & Bramblett

[57] ABSTRACT

A plastic locking ring for locking a lid on a drum includes an elongated strap of extruded plastic polymeric material. The strap has an H-shaped cross section defined by a rib and four flanges extending from either edge of the rib. A fastener extends from one end of the rib and is secured to the other end to form a circular ring locked about the lid and drum. Lips extend downwardly from the inner flanges of the circular ring to stabilize the ring on the lid and drum.

The plastic locking ring is formed by extruding polymeric material through an extrusion die to form a strap, curing the plastic polymer, cutting the plastic strap into predetermined lengths, and fixing a fastener element to each end of each strap length.

16 Claims, 5 Drawing Figures

PLASTIC LOCKING RING AND METHOD OF MAKING

BACKGROUND OF THE INVENTION

This invention relates to locking rings, and more particularly to locking rings for locking a lid to a drum.

It is well known to secure metal lids to fiber storage drums by means of metallic bands. Generally, the downwardly extending rim of the lid is slid over the sides of the drum and, by means of a special clamp, the metallic band is tightened about the rim and drum. Removing the lid from the drum often requires a tool to loosen the clamp. Because the band is under tension, it springs outwardly when opened, at times injuring the person opening the drum due to the sharp edge of the band.

Thus, an object of this invention is to provide a locking ring for securing a lid to a drum without the need for tools in either securing or removing the ring.

Because transportation costs are generally based on weight, including the weight of the containers, a further object of this invention is to provide a locking ring of minimal weight.

Yet another object of this invention is to provide a locking ring which is less costly to produce than the standard rings. In this regard, the locking ring manufacturing process is the same for all sizes and generally does not require additional tools for manufacturing different sizes.

SUMMARY

According to the invention in one of its aspects, an elongated polymeric strap includes a rib and first and second flanges extending from one face of the rib, and fastener elements are fixed to each end of the rib for locking the strap about a lid and drum.

According to other aspects of the invention, one of the fastener elements comprises a pad of loose fibrous material and the other of the fastener elements comprises a plurality of plastic polymer filaments in the form of minute hooks adapted to grasp the fibrous material.

According to other aspects of the invention, two additional flanges extend from the other surface of the rib and protrude beyond the fastener elements.

According to yet other aspects of the invention, longitudinal lips extend downwardly from the first and second flanges to stabilize the strap about the drum.

The method of forming the locking ring includes extruding a strap through an extrusion dye, cutting the strap to predetermined lengths to form individual locking rings, and fixing fastener elements to each end of each strap segment.

The method of forming the locking ring further includes winding the extruded strap about a core and curing the elongated strap in a coil configuration before cutting the strap into the predetermined lengths.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT OF THE INVENTION

Figure 1:
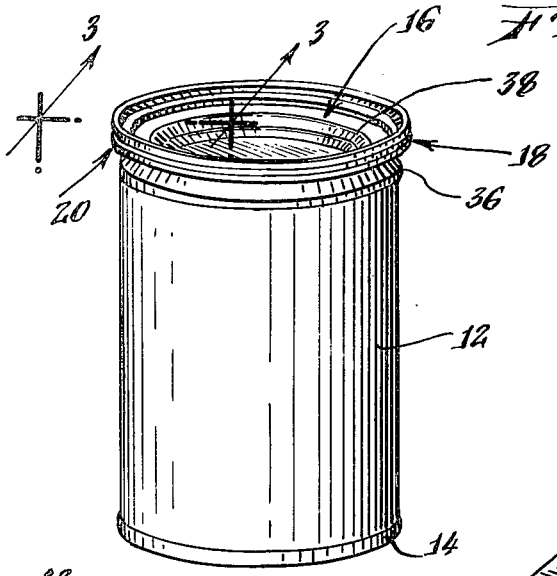
FIG. 1 is a perspective view of a locking ring of the invention securing a lid to a drum.

A drum having a cylindrical fiberboard wall 12 and a closed metal bottom 14 is shown in FIG. 1. A metal lid 16 is secured to the fiberboard wall 12 by a locking ring shown generally at 18. The locking ring is secured to itself by fasteners shown generally at 20.

Figure 2:
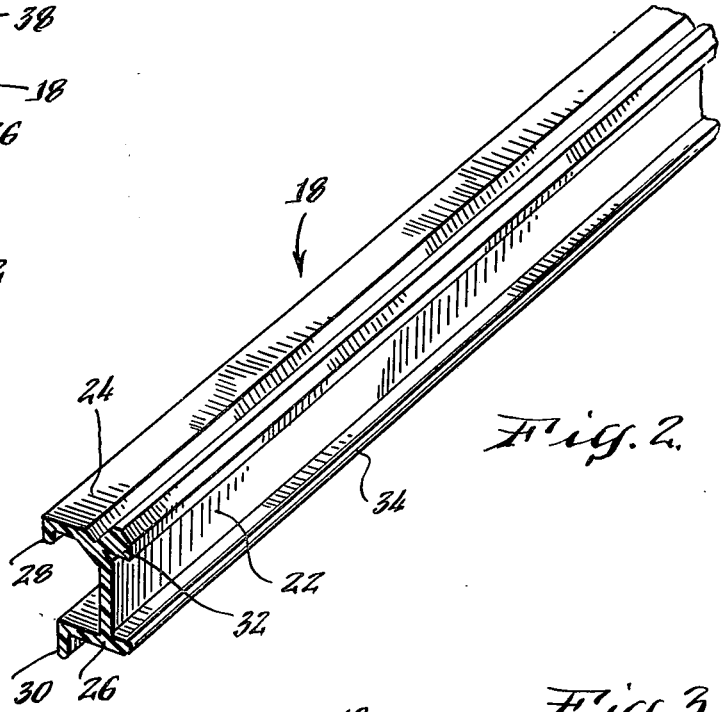
FIG. 2 is an isometric view of one end of a closure strap in accordance with the invention but without a fastener element thereon.

A portion of the locking ring without a fastener is shown in FIG. 2. The ring includes a longitudinal rib 22. First and second longitudinal flanges 24 and 26 extend from either edge of the rib 22 generally normal to one face of the rib. A longitudinal lip 28 extends downwardly from the end of flange 24 toward flange 26 and generally parallel to the rib 22. A longitudinal lip 30 extends from the end of flange 26 downwardly away from flange 24. Extending from either edge of the other face of the rib 22 are third and fourth flanges 32 and 34. The rib 22 and flanges 24, 26, 32 and 34 define a unitary strap having an H-shaped cross section.

The locking ring is formed of an extruded plastic polymeric material. A preferred polymer is relatively inelastic, such as high density polyethylene.

Because the locking ring is a polymer it has several advantages over the generally used metal rings. It is more economical, both because it is less costly to produce and because it is lighter, thereby reducing transportation costs. Further, by coloring the extruded plastic material the locking rings can be color coded to identify the contents of the drum. For example, one color could be used for identifying chemical contents and another color for metallic contents. Finally, because polymers are exceptionally light and flexible the strap can be made of sufficient thickness to avoid the sharp edges found along metallic bands.

Figure 3:
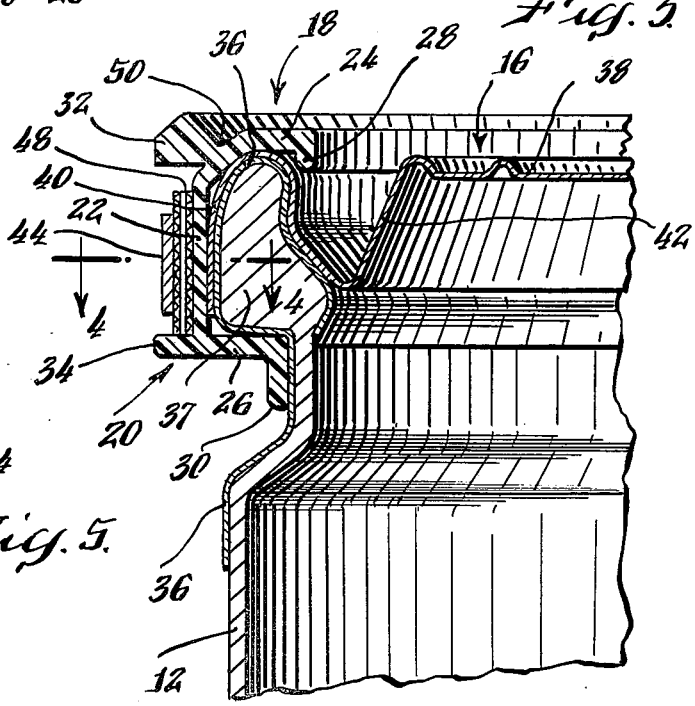
FIG. 3 is an elongated cross section of a portion of the locking ring, lid and drum of FIG. 1 taken substantially along the line 3—3.

Referring to FIG. 3, the fiberboard wall 12 has a metal drum rim 36 wrapped around its upper edge to provide added strength and hardness at the edge. The metal rim 36 and the fiberboard are formed to have a circumferential lip 37 about the open end of the drum extending outwardly and radially with respect to the drum.

The metal lid 16 includes a first top portion 38 extending across the drum opening and a second side wall portion 40 extending downwardly generally normally to the top portion 38. The lid is also formed with a circumferential channel portion 42 between the top portion 38 and side wall portion 40. The channel portion 42 serves both to strengthen the top and to cooperate with the side portion 40 so that the lid fits snugly over the lip 37 of the drum wall.

Once the lid 16 has been placed snugly over the drum rim at the open drum end, a locking ring 18 is wrapped around the rim as shown in FIG. 3. The strap forming the ring has a length approximately equal to the circumference of the drum rim. When joined end-to-end by means to be described, the ring secures the lid 16 to the drum sides 12 with respective first and second flanges 24 and 26 extending over and under the lip 37. The thus locked lid 16 cannot be removed from the drum because upward movement of the lid away from the drum is impeded by flange 24 which is in turn held in place due to its inelastic connection transversely through rib 22 to flange 26 positioned below the lip 37. To stabilize the strap about the lid and drum, lip 28 extends downwardly into the channel portion 42 and lip 30 extends downwardly along the drum wall and metal rim 36.

Figure 4:
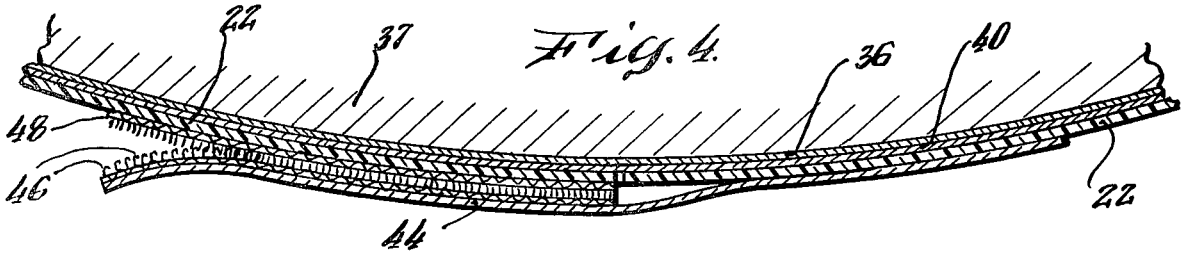
FIG. 4 is a cross sectional view of the locking ring and fastening elements of the invention taken substantially along the line 4—4 of FIG. 3; and, FIG. 5 is a partial side view of drums secured by the locking rings of the present invention and stacked one on another.

The strap 18 forming the locking ring is joined end-to-end about the drum and lid by first and second fastener elements 44 and 48 fixed to either end of the strap. The fasteners may be of the type sold under the trademark Velcro or locking lugs formed on the strap ends. Fastener element 44, extending from one end of the elongated strap, is fixed to the outer face of the longitudinal rib 22 (FIG. 4). This fastener element includes a plurality of minute plastic polymer filaments 46 in the form of hooks extending generally normal to a primary surface of the fastener element. Fixed to the same face of the longitudinal rib 22 as the first fastener element 44, but at the other end, is a pad 48 of loose fibrous material. When the fastener elements are pressed together as shown in FIG. 4, the hooks 46 engage the fibers of the pad 48 to secure the fastener element 44 to the other end of the strap.

Thus, an elongated strap 18 is wrapped around a lid fitted over a drum. A strap is then joined end-to-end by the fastener described to form a locking ring. No special tools are required to secure the lid to the drum and the locking ring can easily be removed by simply pulling the fastener element 44 away from the fibrous pad 48. Due to the nature of the fastener, the locking ring is reusable.

As shown in FIG. 3, the third and fourth flanges 32 and 34 extend outwardly beyond the Velcro fastener. Thus, the outer rim of the locking ring is completely circular, despite the location of the fastener on the rib 22. The drum with lid and locking ring can thus be rolled on its side without interference from the fastener.

Figure 5:
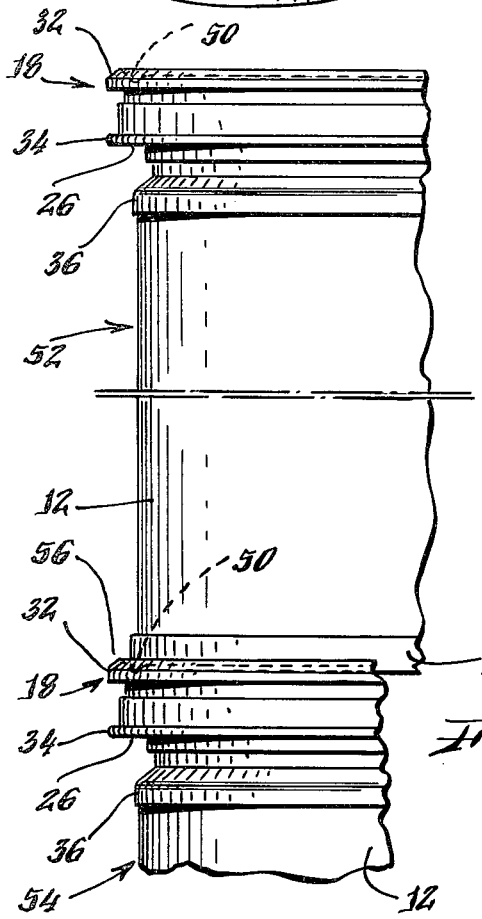

As shown in FIGS. 2 and 3, a notch 50 is formed at the intersection of flanges 24 and 32. When, as shown in FIG. 5, one drum 52 is stacked on another drum 54, a downwardly extending lip 56 around the base of the drum 52 sits securely in the notch 50, thereby ensuring stability of the stacked drums.

A locking ring has been disclosed which is light, cheaply produced, reusable, and easily color coded. Furthermore, the locking ring can be secured and removed without special tools and without the danger of injury.

The above described locking ring also lends itself to a simple method of manufacture. The strap is extruded through an extrusion die having an H-shaped orifice defining the cross section of the strap. The extruded strap is then cut into predetermined lengths as determined by the circumferences of the drums with which the straps are to be used. Hence, a single die can be used to extrude straps for drums of many diameters. Once the straps have been cut into strap segments of the predetermined lengths, the fastener elements already described are fixed to the ends of the straps to complete the locking rings.

In one embodiment of the locking ring the strap is preformed into a circular shape. To form such locking rings, the extruded strap is wound about a core of circular cross section prior to curing and prior to cutting. The strap is then cured while wound about the core so that it assumes the circular form. The thus wound strap forms a cylindrical coil, and by cutting the coil along an axial line a plurality of circular segments are formed. The fastener elements are then fixed to the ends of the segments as before.

While the invention has been particularly shown and described with reference to a preferred embodiment thereof, it will be understood by those skilled in the art that various changes in form and details may be made therein without departing from the spirit and scope of the invention as defined by the appended claims.

What is claimed is:

1. A locking ring for securing a lid to a drum, the drum being of the type having an open end and a radially and outwardly extending circumferential lip about the open end, and the lid being of the type including a first portion extending across the end opening of the drum and a second portion extending generally normal to said first portion about said lip, said locking ring comprising:

an elongated strap of a plastic polymeric material, said strap including a unitary longitudinal rib, first and second longitudinal flanges extending from one face of said rib generally normal to said face of said rib, and third and fourth longitudinal flanges extending from said rib away from said first and second flanges such that said elongated strip has a generally H-shaped cross section, a first fastener element extending from said rib at one end of said strap, and a second fastener element on the other end of said strap for securing said first fastener element to said other end of said strap, whereby said strap may be formed into a circular shape with the first and second flanges directed radially inwardly, and may be secured to itself about the second portion of the lid and about the drum to secure the lid to the drum.

2. The locking ring of claim 1 wherein one of said fastener elements comprises a pad of loose fibrous material and the other of said fastener elements comprises a plurality of minute plastic polymer filaments in the form of hooks extending from a primary surface of said other fastener element, whereby said strap is secured to itself by pressing said first fastener element against said second fastener element.

3. The locking ring of claim 1 further comprising a longitudinal notch formed generally at the intersection of said first and third flanges on the side of said flanges away from said second and fourth flanges.

4. A locking ring for securing a lid to a drum, the drum being of the type having an open end and a radially and outwardly extending circumferential lip about the open end, and the lid being of the type including a first portion extending across the end opening of the drum and a second portion extending generally normal to said first portion about said lip, said locking ring comprising:

an elongated strap of a plastic polymeric material, said strap including a unitary longitudinal rib, first and second longitudinal flanges extending from one face of said rib generally normal to said face of said rib, and a longitudinal lip extending from the edge of said first flange toward said second flange and generally parallel to said rib, a first fastener element extending from said rib at one end of said strap, and a second fastener element on the other end of said strap for securing said first fastener element to said other end of said strap, whereby said strap may be formed into a circular shape with the first and second flanges directed radially inwardly, and may be secured to itself about the second portion of the lid and about the drum to secure the lid to the drum.

5. The locking ring of claim 4 further comprising a second lip extending from the edge of said second flange, away from said first flange, and generally parallel to said rib.

6. The locking ring of claim 5 further comprising third and fourth longitudinal flanges extending from said rib away from said first and second flanges such that said elongated strap has a generally H-shaped cross section.

7. The locking ring of claim 6 wherein one of said fastener elements comprises a pad of loose fibrous material and the other of said fastener elements comprises a plurality of minute plastic polymer filaments in the form of hooks extending from a primary surface of said other fastener element, whereby said strap is secured to itself by pressing said first fastener element against said second fastener element.

8. The locking ring of claim 7 further comprising a longitudinal notch formed at the general intersection of said first and third flanges on the side of said flanges away from said second and fourth flanges.

9. A locking ring for securing a lid to a drum, the drum being of the type having an open end and a radially and outwardly extending circumferential lip about the open end, and the lid being of the type including a first portion extending across the end opening of the drum and a second portion extending generally normal to said first portion about the sides of said drum, said locking ring comprising:

an elongated strap of extruded plastic polymeric material, said strap having a generally H-shaped cross section defined by a unitary longitudinal rib and first, second, third and fourth longitudinal flanges extending from either edge of said rib and generally normal to said rib, said strap being preformed into a circular shape with said flanges extending radially, a first fastener element extending from said rib at one end of said strap, and a second fastener element on the other end of said strap on the face of said rib facing outwardly for securing said first fastener element to said other end of said strap, whereby said strap may be secured to itself about the second portion of said lid and about said drum to secure the lid to the drum.

10. The locking ring of claim 9 further comprising a longitudinal lip extending from the edge of said first flange toward said second flange and generally parallel to said rib.

11. The locking ring of claim 10 further comprising a second lip extending from the edge of said second flange, away from said first flange, and generally parallel to said rib.

12. The locking ring of claim 11 wherein one of said fastener elements comprises a pad of loose fibrous material and the other of said fastener elements comprises a plurality of minute plastic polymer filaments in the form of hooks extending from a primary surface of said other fastener element, whereby said strap is secured to itself by pressing said first fastener element against said second fastener element.

13. The locking ring of claim 12 further comprising a longitudinal notch formed at the general intersection of said first and third flanges on the side of said flanges away from said second and fourth flanges.

14. The locking ring of claim 9 wherein one of said fastener elements comprises a pad of loose fibrous material and the other of said fastener elements comprises a plurality of minute plastic polymer filaments in the form of hooks extending from a primary surface of said other fastener element, whereby said strap is secured to itself by pressing said first fastener element against said second fastener element.

15. A method of forming a locking ring for securing a lid to a drum, the drum being of the type having an open end and a radially and outwardly extending lip about the open end, and the lid being of the type including a first portion extending across the end opening of the drum and a second portion extending generally normal to said first portion about the sides of said drum, said method comprising the steps of:

(a) extruding an elongated strap of plastic polymeric material through an extrusion die;

(b) winding said elongated strap about a core of circular cross section;

(c) curing said strap of plastic polymeric material in a cylindrical coil;

(d) cutting said plastic polymeric strap into predetermined lengths as determined by the circumferences of drums with which the rings are to be used; and (e) providing a fastener element at each end of each of said lengths of plastic polymeric material.

16. A locking ring for securing a lid to a drum, the drum being of the type having an open end and a radially and outwardly extending circumferential lip about the open end, and the lid being of the type including a first portion extending across the end opening of the drum and a second portion extending generally normal to said first portion about said lip, said locking ring comprising:

an elongated strap of a plastic polymeric material, said strap including a unitary longitudinal rib and first and second continuous longitudinal flanges extending from one face of said rib generally normal to said face of said rib, and means for detachably fastening one end of said strap to the other end of said strap, whereby said strap may be formed into a circular shape with the first and second flanges directed radially inwardly, and may be secured to itself about the second portion of the lid and about the drum to secure the lid to the drum.

* * * * *